US008280741B2

(12) United States Patent
Colin et al.

(10) Patent No.: US 8,280,741 B2
(45) Date of Patent: Oct. 2, 2012

(54) METHOD AND SYSTEM FOR THE ENTRY OF FLIGHT DATA FOR AN AIRCRAFT, TRANSMITTED BETWEEN A CREW ON BOARD THE AIRCRAFT AND GROUND STAFF

(75) Inventors: Michel Colin, Colomiers (FR); Daniel Ferro, Muret (FR)

(73) Assignee: Airbus Operations SAS, Toulouse (FR)

( * ) Notice: Subject to any disclaimer, the term of this patent is extended or adjusted under 35 U.S.C. 154(b) by 1056 days.

(21) Appl. No.: 12/039,549

(22) Filed: Feb. 28, 2008

(65) Prior Publication Data

US 2008/0221886 A1 Sep. 11, 2008

(30) Foreign Application Priority Data

Jan. 3, 2007 (FR) ..... 07 53572

(51) Int. Cl.
*G10L 11/00* (2006.01)

(52) U.S. Cl. ..... 704/275; 704/231; 704/270

(58) Field of Classification Search ..... 704/270, 704/275; 340/945
See application file for complete search history.

(56) References Cited

U.S. PATENT DOCUMENTS 6,720,890 B1 * 4/2004 Ezroni et al. ..... 340/945
7,286,984 B1 * 10/2007 Gorin et al. ..... 704/254
7,580,377 B2 * 8/2009 Judd ..... 370/277
7,606,715 B1 * 10/2009 Krenz ..... 704/275
7,774,202 B2 * 8/2010 Spengler et al. ..... 704/236
2003/0006910 A1 1/2003 Dame
2007/0189328 A1 * 8/2007 Judd ..... 370/466

FOREIGN PATENT DOCUMENTS

WO 98/12685 A 3/1998

OTHER PUBLICATIONS

Best E et al: "Controller-pilot data link results from NASA and FAA Dallas-Fort Worth 2000 test and demonstration" 20th DASC. 20th Digital Avionics Systems Conference. Proceedings Oct. 14-18, 2001 Daytona Beach, FL, USA, vol. 1, Oct. 2001, pp. 2.D.1-1-2.D.1-9, XP002450245, 20th DASC. 20th Digital Avionics Systems Conference (Cat. No. 01CH37219) IEEE Piscataway, NJ, USA ISBN: 0-7803-7034-1.

Rankin J M et al: "Controller interface for controller-pilot data link communications" Digital Avionics Systems Conference, 1997. 16th DASC., AIAA/IEEE Irvine, CA, USA Oct. 26-30, 1997, New York, NY, USA, IEEE, US, vol. 2, Oct. 26, 1997, p. 7.1-19-7.1-25.

* cited by examiner

*Primary Examiner* — Douglas Godbold
(74) *Attorney, Agent, or Firm* — Perman & Green, LLP

(57) ABSTRACT

A system of assistance in the entry of flight data for an aircraft transmitted between a crew on board the aircraft and a ground staff including, a radiofrequency communications link to transmit flight data between the crew and the ground staff. At least one means of sending and one means of receiving data on board the aircraft, wherein the system includes a voice recognition means capable of detecting a piece of data of a predefined type emitted, during the communications call, by the crew or the ground staff and a means of analysis and transcription of this piece of data in digital or alphanumeric form.

13 Claims, 2 Drawing Sheets

METHOD AND SYSTEM FOR THE ENTRY OF FLIGHT DATA FOR AN AIRCRAFT, TRANSMITTED BETWEEN A CREW ON BOARD THE AIRCRAFT AND GROUND STAFF

BACKGROUND

1. Field

The disclosed embodiments relate to a method and a system for assistance in the entry of flight data for an aircraft transmitted between the ground staff and the crew on board the aircraft. The disclosed embodiments propose the use of a voice recognition device for the detection and analysis on board the aircraft of certain data transmitted during communication and the display of this data on a display unit of the cockpit. It simplifies the task of the crew and therefore secures the reception of the data.

The disclosed embodiments find applications in aeronautics and especially in in-flight communications to secure the reception of the data transmitted by the ground staff to the crew on board the aircraft.

2. Brief Description

When an aircraft is in flight, the crew on board the aircraft, for example the pilot or the copilot, communicate with the ground staff, for example the air traffic controller, in order to exchange data on the flight.

This data may be data on the flight sector, the flying level, speed, frequency of transmission/reception of messages to be exchanged with the ground staff, etc. In particular, this data may relate to the VHF or HF frequency of the RF communications link with the air traffic controller.

Indeed, each zone of the air space is sectorized and an aircraft has only one air traffic controller as its interlocutor in a given sector with whom it communicates on a determined frequency channel.

Thus, when an aircraft is going to leave a sector to enter a new sector, it is important that the crew of the aircraft should know the frequency of the radio channel on which it will communicate with the air traffic controller of the new sector. The crew of the aircraft must be informed of the radiofrequency of the new sector before leaving the old sector in order to be able to come into contact with the air traffic controller as soon as it enters the new sector. To this end, it is necessary to ensure that the information new radiofrequency has been clearly understood by the crew.

For example, when an aircraft reaches the end of a first sector, the air traffic controller of the first sector sends a radio-link message to the crew indicating the VHF or HF frequency on which the crew will communicate with the air traffic controller of the second sector. Generally, the pilot in charge of communications on board the aircraft sends confirmation to the air traffic controller of the first sector indicating that he has clearly understood the frequency by readback, i.e. by repeating the frequency. This frequency is then registered by the pilot or by another member of the crew in a display unit of the cockpit, for example a panel for the management of the radiofrequency equipment known as a radio management panel (RMP). This recording is done by means of a digital selection device or a keyboard. Once this frequency has been recorded in the RMP, it is put into application. The crew is then able to communicate with the air traffic controller of the second sector.

To store this frequency value, the pilot or another member of the aircraft crew can note it in writing before entering it into the display unit. He can thus use his own short-term memory. Should the aircraft be equipped with a code wheel RMP, the pilot can use a window known as the MCDU (multipurpose control and display unit) to enter the value of this frequency and thus store it for as long as it has not been confirmed. Whatever the way in which this frequency has been stored (in the pilot's head or entered by keyboard or written on a piece of paper) and as soon as it has been confirmed, the pilot must record it manually in the active window of the display unit. He must then visually verify the value of the frequency recorded and then validate it by means of a key dedicated to the activation of this value. In other words, when the value of the frequency has been recorded in the RMP, the pilot must verify the recorded value and put it into application.

These steps are relatively painstaking in terms of work load inasmuch as these communication calls are repeated very frequently during one and the same flight.

Furthermore, the quantity of the data communicated by the air traffic controller may sometimes be very great, especially when the aircraft is in a difficult phase of flight. It is then difficult for the pilot or the other members of the crew to memorize all the information provided by the air traffic controller or even to write it down or enter it by means of the MCDU or the RMP. Now, if the value of the frequency is not accurately recorded in the RMP, the communications with the air traffic controller cannot be set up, with all the risks and problems that this would entail.

To simplify this communications procedure and lighten the work load of the crew, it can be planned to use a voice recognition device that would enable the recognition of the pieces of data transmitted by the aircraft controller and their recording in digital form in the RMP. However, the use of a classic voice recognition device used in a cockpit would present the following drawbacks:

Not all the sounds and signals audible in a cockpit are relevant to voice recognition. It is therefore necessary to activate the voice recognition prior to the ground/aircraft transmission of the frequency so that the frequency can be selected and recognized without being disturbed by the other sounds and speech put out in the cockpit. It will therefore be up to the pilot or another member of the crew to activate the voice recognition device when the data on the frequency of the radio channel is given by the air traffic controller. In the prior art, this manual activation would bring about an additional constraint for the crew.

The voice recognition device must have a high signal-to-noise ratio so that the ambient noise does not disturb the detection of the data when it is sent out by the air traffic controller or by the pilot. An efficient signal-to-noise ratio can be obtained for example by placing one or more microphones before or in the proximity of the pilot or else by using algorithms making it possible to distinguish ambient noise in real time so as to eliminate these noises at least partially.

The user must read or listen to the frequency that has been recognized by the voice recognition device before it is validated. If the recognition has been correct, the pilot must validate the frequency.

The pilot must transfer the value of the frequency recognized by the voice recognition device to the display unit.

As a consequence, the use of a classic voice recognition device would be limited by the intrinsic performance of the device itself. Indeed, such a device has a recognition rate below 100%, in the region of 85 to 95%. Since the recognition is not sure at 100%, it can introduce a functioning artifact which provides little security to this solution low security and even makes it counterproductive.

To improve the voice recognition rate, it is necessary for the air traffic controller to take particular care in the pronunciation of the data communicated. Now it is difficult to ask this of an air traffic controller who transmits a large number of information elements and especially information other than information on the radiofrequency.

SUMMARY

The disclosed embodiments are aimed precisely at overcoming the drawbacks of the techniques explained here above. To this end, the disclosed embodiments propose a method and a system of assistance in the entry of data on the flight of an aircraft transmitted between a crew on board the aircraft and a ground staff, wherein the data is of a predefined type so that it can be detected by voice recognition from among a flow of data and sound signals. The detected piece of data is analyzed and then recorded in a window of a display unit.

More precisely, the disclosed embodiments relate to a system of assistance in the entry of flight data for an aircraft transmitted between a crew on board the aircraft and a ground staff comprising:

a radiofrequency communications link to transmit flight data between the crew and the ground staff, at least one means of sending and one means of receiving data on board the aircraft, at least one display unit capable of displaying the flight data, the system comprising:

a voice recognition means capable of detecting a piece of data of a predefined type emitted, during the communications call, by the crew or the ground staff, and a means of analysis and transcription of this piece of data in digital or alphanumeric form.

The system of the disclosed embodiments can comprise one or more of the following characteristics:

it comprises at least one display unit capable of displaying flight data and comprising a standby window in which the detected data is provisionally displayed and an active window in which the data is displayed for as long as it is applied, the display unit comprises a selector that transfers the piece of data from the standby window to the active window during the validation by the crew, the voice recognition means is capable of making a detection, from among the sound signals and data, of a piece of data in the form of a radiofrequency, the voice recognition means is activated by an activation means controlling the activation of said at least one data sending means, the voice recognition means comprises a database obtained by learning.

The disclosed embodiments also relate to a method of assistance in the entry of flight data for an aircraft transmitted between a crew on board the aircraft and a ground staff, wherein:

the ground staff sends the crew a piece of data by means of a radiofrequency link, the crew receives this piece of data, confirms this data and puts it into application for the pursuit of the flight, wherein:

the piece of data is a predefined type of data, this piece of data is detected by voice recognition, analyzed and recorded in a window of a display unit of the aircraft.

The method of the disclosed embodiments may also comprise one or more of the following characteristics:

the piece of data is a radiofrequency detected from among a plurality of sound signals and data transmitted on the radiofrequency link, the piece of data is detected when it is confirmed by the crew, i.e. at the time of its transmission from the aircraft to the ground, the piece of data is displayed in a temporary window of the display unit called a standby window, when the piece of data is validated by the crew, it is transferred from the standby window to an active window of the display unit, when the piece of data is invalidated by the crew, it is reconfirmed by said crew and then detected and analyzed again, when the detected piece of data is recognized partially, its value is complemented by learnt and/or predefined data elements.

The disclosed embodiments also relate to an aircraft comprising means to implement the method described here above. It also relates to an aircraft comprising a system as described here above.

DETAILED DESCRIPTION

The disclosed embodiments propose a method of assistance in the entry of data transmitted between a ground staff and the aircraft crew in which a piece of data of a particular predefined type is detected by voice recognition from among a set of sound signals and data transmitted by the radiofrequency link linking the ground staff and the crew. The communications method of the disclosed embodiments is aimed at simplifying the tasks of the crew on board the aircraft, especially when the air traffic controller transmits a piece of data on the frequency of the radio channel to which the aircraft must be tuned in order to communicate with the air traffic controller of the next sector. This method thus improves the security of reception of the frequency data transmitted by the ground staff to the aircraft.

Here below in the description, the ground staff will be deemed to be the air traffic controller and the crew on board the aircraft will be deemed to be the pilot, it being understood that other persons may have to communicate on the radiofrequency link, especially the copilot.

Figure 1:
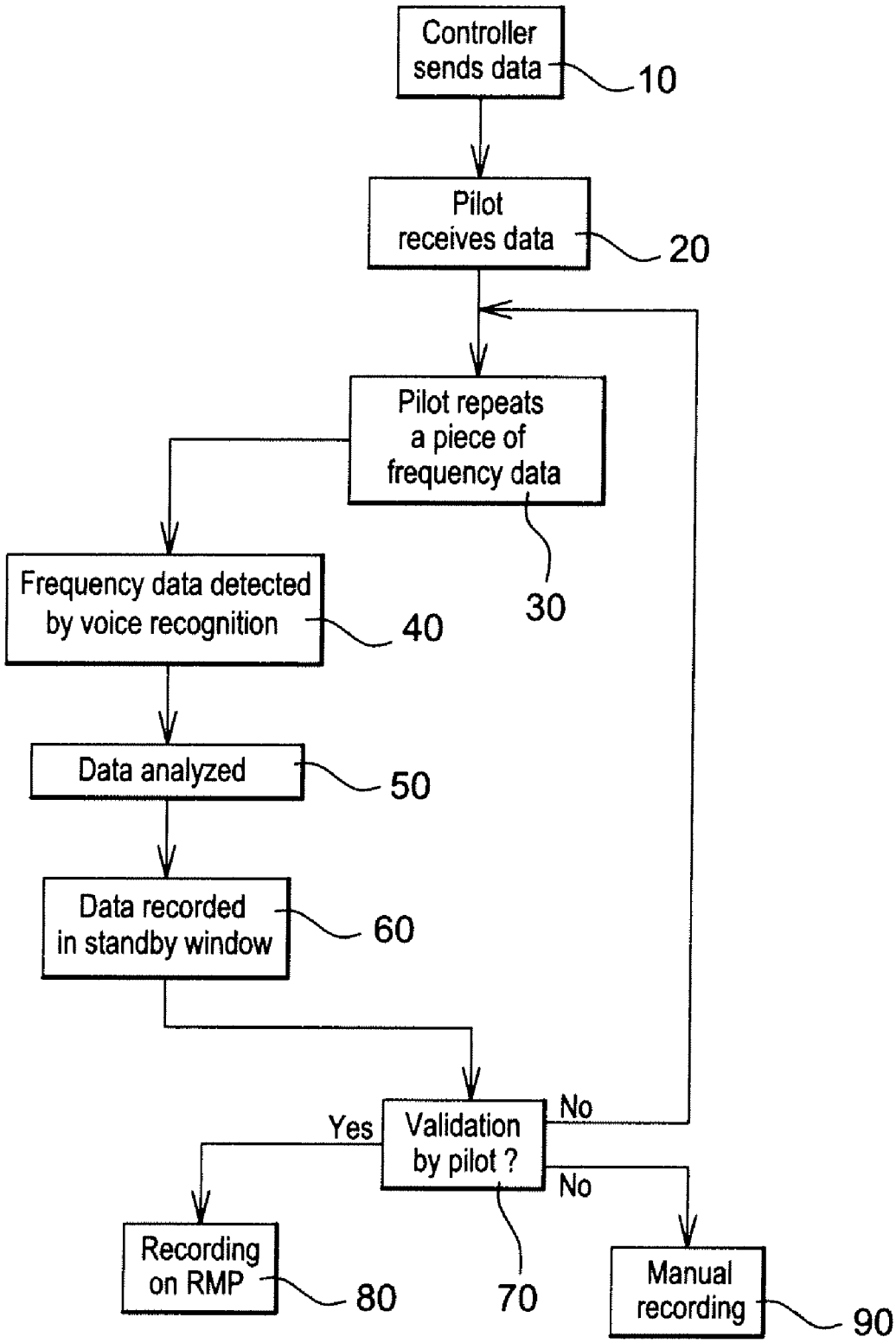
FIG. 1 is a functional diagram of the method of the disclosed embodiments.

FIG. 1 is a functional diagram showing the different steps of the method of the disclosed embodiments. In a first step 10, the air traffic controller uses the radiofrequency link to send the different pieces of data to be transmitted to the pilot of the aircraft for the remaining part of the flight. Among these pieces of data, he transmits the data on frequency of the radio channel of the next sector. At the step 20, the pilot takes reception of this data. To confirm that he has clearly understood this data, especially the piece of data on frequency, the pilot repeats this data and especially the value of the frequency data (step 30). When this data is being repeated the pilot must act on the means of activation of the radio transmission so that the repeated data is transmitted to the radio means via the audio management system or audio management unit (AMU). These activation means are called PTT (push to talk) means. The actuation of the PTT means simultaneously puts a voice recognition device into operation. This voice recognition device is capable of recognizing the piece of frequency data repeated by the pilot (step 40). As shall be explained here below, the voice recognition device is capable of detecting the frequency data from among all the other pieces of data repeated by the pilot on the radio link and all the ambient noises. When the frequency data has been detected by the voice recognition device, it is analyzed (step 50) for example by the same voice recognition device so that it can be recorded in alphanumeric form. In particular, when the piece of data is a frequency value, it is transcribed in numerical form.

Once transcribed in numerical form, the frequency data is recorded in a window of a display unit, for example in a window of the RMP. In a preferred embodiment of the disclosed embodiments, it is recorded first of all in a standby window (step 60). This standby window is designed to receive the piece of data on frequency temporarily. The pilot can then ascertain that the frequency value recorded in this standby window truly corresponds to the frequency value that he has heard from the air traffic controller. If this piece of data corresponds, then the pilot can validate the frequency data (step 70). During the validation, for example through the actuation of a specific key on the display unit or on the control keyboard, the frequency data is automatically transferred from the standby window to a window of the RMP dedicated to the frequencies of the radio channels, known as an active window. Once the frequency value has been recorded in the RMP (step 80), said frequency value can be put into application for the rest of the flight.

If the frequency value recorded in the standby window does not correspond to the value repeated by the pilot, then the pilot has the possibility of not validating the piece of data, for example by erasing it from the standby window. He can reiterate the voice recognition process by repeating the frequency data. The method is then repeated from the step 30 onwards.

If the frequency value recorded in the standby window does not correspond to the value heard by the pilot, whether it is the first or second iteration of detection by voice recognition, then it is possible for the pilot to record it on the RMP manually, as is done classically today. This possibility of manual recording is a safety feature of the disclosed embodiments, for example in case there is a dysfunction of the voice recognition device.

In the method of the disclosed embodiments as just described, the frequency data is recognized by the voice recognition device by comparison with models learnt and recorded in a database of said device. The frequency data elements are HF or VHF frequency values. They therefore have a predefined, particular format. The VHF frequency data takes the form of a numerical value ranging from 118.000 to 136.990. The HF frequency data takes the form of a numerical value included between 2.800 and 23.999. Owing to their particular format, the frequencies of an ATC type (VHF or HF frequency) are recognized by the voice recognition device from among those other data that can be transmitted on the radiofrequency link.

In the embodiment that has just been described, the voice recognition is done during a repetition of the data by the pilot. In another embodiment of the disclosed embodiments, the voice recognition can be done during the transmission of data by the air traffic controller. Indeed, since the voice recognition is set up for a particular data format (HF or VHF frequency format), the voice recognition device seeks to recognize only the data having this format. The voice recognition done on board the aircraft can therefore be done during the reception of data sent out by the air traffic controller, as it is done during the transmission of data by the pilot. It must be noted however that the voice recognition is currently easier during the repetition of the data by the pilot for reasons of sound quality (no parasitic sound signals in transmission).

The frequency data to be recognized is a radiofrequency, for example an ATC frequency, i.e. a frequency relative to civilian communications in an aircraft. The voice recognition device is capable of recognizing whether the frequency transmitted by the communications links is a radiofrequency, i.e. an HF or VHF radiofrequency with a particular format as defined here above. The voice recognition device comprises a database in which a certain number of ATC frequency values are stored. The voice recognition device is thus capable of recognizing the format of a radiofrequency. When it recognizes a frequency having this format, it analyzes it in order to transcribe the recognized sounds corresponding to this frequency in numerical form.

When the frequency has been analyzed, the voice recognition device displays this frequency in a standby window of the RMP. This standby window can also be a window adapted to voice recognition. It can also be a scratch-pad window of the RMP, i.e. a window used as a transition before a final insertion of a piece of information and especially of the frequency value in the RMP.

If the pilot recognizes the frequency recorded in the standby window as being the frequency that has heard from the air traffic controller, he can switch the radiofrequency from the standby window to the active window by simple action on a selector. He then selects this frequency as an active communications frequency for the radio means selected. The value displayed in the standby window is then transferred to the active window.

If the voice recognition device has not recognized the radiofrequency, it does not take account of the information received and does not validate the frequency. The value displayed in the standby window can then be erased and the value displayed in the active window remains active, i.e. in application.

In one embodiment of the disclosed embodiments, the frequency is recorded directly in the active window of the display unit. In this case, if the displayed frequency is not validated by the pilot, it is erased from the window and the former frequency is re-recorded. If it is validated by the pilot, then it remains displayed in the window of the display unit and its value is put into application immediately.

Figure 2:
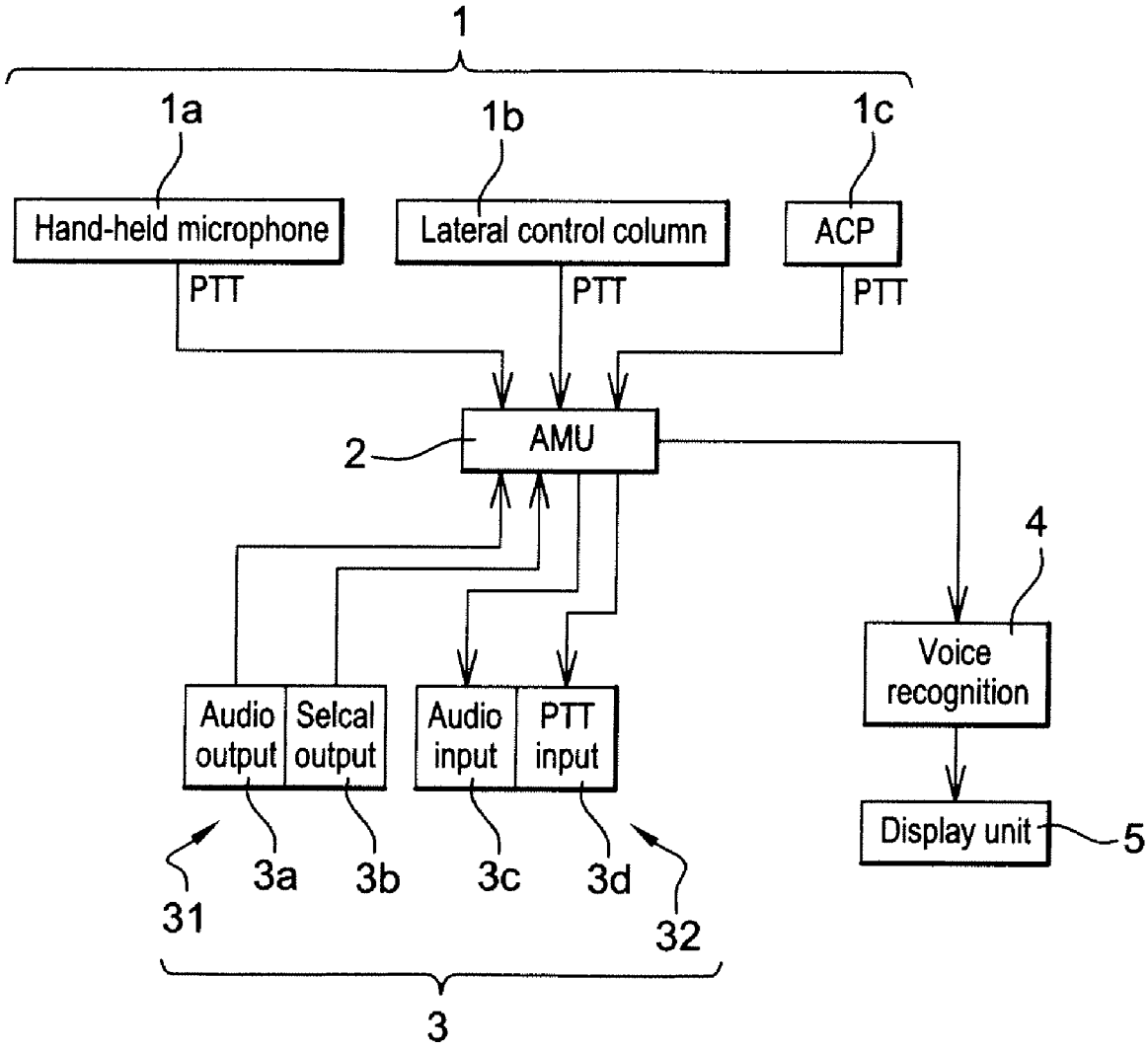
FIG. 2 is a schematic view of the system of the disclosed embodiments.

FIG. 2 shows an example of a communications system of the disclosed embodiments when the voice recognition is done at the time of the repetition of the data by the pilot. This system comprises means 1 for activation of radio transmission, each corresponding to an activation button or PTT (push to talk) button enabling the pilot to activate the sending, on the radio channel, of information pronounced by him when he repeats the pieces of data heard in order to confirm it. These actuation means can be situated in a hand-held microphone 1*a* on a lateral control column 1*b* or on an audio control device 1*c* of the audio control panel (ACP) type.

Each of these activation means 1 is connected to an audio management unit 2 or AMU and sends it the PTT information in the form of discrete signals. The AMU 2 centralizes all the information on radiofrequency transmission and reception. The VDR or HFDR radio apparatuses 3 are both reception means (31) and transmission means (32) for reception and transmission from the aircraft and to the aircraft. The AMU 2 takes responsibility for routing the audio signals received from outside by the radio means 3 (through their outputs 3*a* and 3*b*) to the pilot as well as the audio signals sent out by the pilot outwards in conveying them to the radio means 3 (through their inputs 3*c* and 3*d*), for example on the radio channel VHF1, VHF2 or VHF3 or again the radio channel HF1 or HF2. It therefore receives information from the air traffic controller by the audio output 3*a* of the radio means 3. It also receives information coming from the output Selcal 3*b*, i.e. signals providing information about the reception of information intended for the crew. The AMU 2 sends information pronounced by the pilot i.e. the signal coming from the microphone, to an audio input 3*c*. It also transmits the signals coming from the PTT of the activation means to the discrete input 3*d* called a PTT input. The AMU also transmits information to the voice recognition device 4. This information transmitted to the voice recognition device 4 comprises especially the pilot's words and especially the data repeated by the pilot. The voice recognition device 4 is connected to a display unit 5, for example an RMP, in order to send the analyzed frequency data to it.

In the embodiment of FIG. 2, the PTTs are used to activate the monitoring by the voice recognition device 4. Indeed, since the pilot is obliged to press a PTT so that his speech is sent out on the radio channel, this PTT can form a means of control of voice recognition. In other words, the device 4 gets activated as soon the pilot activates an actuation means 1 enabling him to make transmission on an audio channel known as being potentially an ATC channel.

In another embodiment of the disclosed embodiments, the voice recognition device can be put into operation by the pilot using an on/off switch. Thus, the voice recognition is activated solely by a decision of the pilot.

Whatever the mode of operation, a specific indicator light displayed on the RMP may provide an indication, depending on its color or its state (on or off) of whether the voice recognition device is activated or not.

As explained here above, the voice recognition device provides assurance firstly of the detection of the frequency data, i.e. its recognition and secondly the analysis of this data in order that it may be transcribed in the form of data that can be displayed on a display unit. In another embodiment of the disclosed embodiments, the detection of the value of frequencies is done by the voice recognition device and the analysis of the values detected is done by an analysis device connected to the voice recognition device.

The voice recognition device comprises a database created and/or complemented by learning. The learning may be set up in advance, i.e. before the system is installed in the aircraft. It can also be set up gradually, as and when the flights takes place, by acquisition of different types of pronunciation of the pilots or air traffic controllers. In the event of voice recognition during repetition of data by the pilot, the voice recognition device may be configured so as to be adapted to the pilots likely to be at the controls of the aircraft. To this end, the voice recognition device includes a self-learning function and a pilot identification function. The identification of the pilot can be done by declaration or automatically; for example it can be a biometric identification, an RFID (radiofrequency identification), a reading of a badge, etc. The self-learning process is performed for each pilot with a database adapted to each pilot's mode of speech and pronunciation. This learning, which may have taken place before or as and when the voice recognition device is used, extends the database of said voice recognition device, thus improving its efficiency.

Furthermore, the learning process comprises an adaptation to the different ways of stating a number. The frequency data will of course comprise several digits. These digits may be voiced in different ways:

in the English manner, all the digits being pronounced one after the other, in the French manner, in specifying the hundreds, tens, etc, according to the user's accent.

Certain figures themselves may be stated in several ways. The voice recognition device should be able to recognize a same figure whatever the way in which it is said. For example, the number 1 can be recognized from the sounds "one", "un" or "unity". The figure 0 can be recognized by the sounds "zero", "zero" or "o". The comma and the decimal point should be recognized from the sounds "decimal", "dot", "decimal point", "comma", "point", "decimal".

Depending on the user, the manner of stating the numerical value corresponding to the frequency may also differ. Some persons may state all the figures of the frequency or else only a part of the figures, the unstated figures of this frequency being classic, known pieces of data because they are similar whatever the value of the frequency. For example, the frequency 118.100 can be stated without using the first 1 or the comma. The air traffic controller may say for example, "contact the tower on 18, unity". The voice recognition device then recognizes the value 18.1. It can then analyze this value and deduce the full value 118.100 therefrom. The completeness of the frequency value can, in this case, be obtained by the voice recognition device which completes the partially recognized value by data elements that it has learnt after a determined timeout.

The completeness of the frequency value can also be obtained by the RMP during the recording of said value on the RMP. Indeed, certain RMPs have a device for entering digital values which prevent the entry of all the figures during an entry of the frequency by hand. In the system of the disclosed embodiments, it is possible to use this capacity of the RMPs during the automatic recording of the frequency data by the voice recognition device. For example, if the first figure entered is an 8 or a 9, the RMP proposes the figures in the hundreds, tens and decimals. Thus, in the example of the frequency 118.100, if the air traffic controller announces the frequency in stating "18, unity", and if the voice recognition device decodes 18.1 and transmits this value 18.1 to the RMP, the RMP may be capable itself completing this value so as to display 118.100. The partially recognized frequency value is then completed by known, predefined data elements.

What is claimed is:

1. A system of assistance in the entry of flight data for an aircraft transmitted between a crew on board the aircraft and a ground staff comprising:

a radiofrequency communications link configured to transmit spoken flight data from the ground staff to the crew, a receiver configured for receiving the transmission of spoken flight data on board the aircraft, a voice recognition means capable of detecting a piece of spoken VHF or HF frequency data within the received spoken flight data or repeated by the crew as part of receiving the transmission, and recognizing this piece of spoken frequency data by comparison with models learnt and recorded in a database created and/or complemented by learning, this voice recognition means including a pilot identification function, a means of control of voice recognition, and a means of analysis and transcription of this piece of data to a standard format for display in digital or alphanumeric form; and at least one display unit that is capable of displaying flight data, the at least one display unit comprising a standby window in which the detected data is provisionally displayed and an active window in which the data is displayed for as long as it is applied.

2. A system according to claim 1, wherein the display unit comprises a selector that transfers the piece of data from the standby window to the active window during the validation by the crew.

3. A system according to claim 1, wherein the voice recognition means is capable of making a detection, from among the sound signals and data, of a piece of data in the form of a radiofrequency.

4. A system according to claim 1, wherein the voice recognition means is activated by an activation means controlling the activation of said at least one data sending means.

5. A system according to claim 1, wherein the voice recognition means comprises a database obtained by learning.

6. A method of assistance in the entry of flight data for an aircraft transmitted between a crew on board the aircraft and a ground staff:

providing to the crew a piece of spoken data sent by the ground staff by means of a radiofrequency link, the piece of spoken data comprising a spoken VHF or HF frequency data within a transmission of spoken flight data, receiving confirmation by the crew of said piece of spoken data receiving from the crew said piece of spoken data into application for the pursuit of the flight, and at the reception of the transmission of spoken flight data including this piece of spoken frequency data or at its confirmation by the crew on board the aircraft as part of receiving the transmission, detecting the piece of spoken frequency data within the spoken flight data using a voice recognition device by taking into account a pilot identification and by comparison with models learnt and recorded in a database created and/or complemented by learning, analyzing and transcribing the piece of spoken data to a standard format, recording the piece of spoken data in a window of a display unit of the aircraft, wherein the display unit comprises both a standby window and an active window, and provisionally displaying the piece of spoken data in the standby window and displaying the piece of spoken data in the active window for as long as it is applied.

7. A method according to claim 6, wherein the piece of data is a radiofrequency detected from among a plurality of sound signals and data transmitted on the radiofrequency link.

8. A method according to claim 6, wherein the piece of data is detected when it is confirmed by the crew.

9. A method according to claim 6 wherein, when the piece of data is validated by the crew, it is transferred from the standby window of the display unit to the active window of the display unit.

10. A method according to claim 8 wherein, when the piece of data is invalidated by the crew, it is reconfirmed by said crew and then detected and analyzed again.

11. A method according to claim 6 wherein, when the detected piece of data is recognized partially, its value is complemented by learnt and/or predefined data elements.

12. An aircraft comprising the system according to claim 1.

13. Aircraft comprising a communication system further comprising an audio management unit and a voice recognition device configured to implement the method according to claim 6.

* * * * *